US005313689A

United States Patent [19]

Oexler

[11] Patent Number: 5,313,689

[45] Date of Patent: May 24, 1994

[54] SLIVER DRAWING ROLLERS DRIVEN BY BELTS INCLUDING BELT CLEANERS

[75] Inventor: Rudolf Oexler, Ingolstadt, Fed. Rep. of Germany

[73] Assignee: Schubert & Salzer Maschinenfabrik Aktiengesellschaft, Ingolstadt, Fed. Rep. of Germany

[21] Appl. No.: 687,859

[22] PCT Filed: Oct. 9, 1990

[86] PCT No.: PCT/EP90/01688

§ 371 Date: May 31, 1991

§ 102(e) Date: May 31, 1991

[87] PCT Pub. No.: WO91/05893

PCT Pub. Date: May 2, 1991

[30] Foreign Application Priority Data

Oct. 17, 1989 [DE] Fed. Rep. of Germany ..... 3934576

[51] Int. Cl.[5] ..... D01H 5/18; F16H 7/10

[52] U.S. Cl. ..... 19/293; 474/92

[58] Field of Search ..... 19/236, 159 R, 278, 19/293, 131, 245, 262, 265; 57/90, 105; 474/84, 87, 101, 132, 134, 137, 148, 167, 261

[56] References Cited

U.S. PATENT DOCUMENTS

| | | | |
|---|---|---|---|
| 1,490,377 | 4/1924 | Freeman | 474/92 |
| 1,538,349 | 5/1925 | Oates | 19/293 X |
| 2,082,540 | 6/1937 | Geare | 474/84 |
| 2,387,703 | 10/1945 | Jones | 19/265 X |
| 2,519,769 | 8/1950 | Kooistra | 57/105 |
| 2,549,501 | 4/1951 | McClelland | 474/87 |
| 2,549,718 | 4/1951 | Spang | 15/256.5 |
| 2,560,307 | 7/1951 | Slemmons | 474/92 X |
| 2,722,323 | 11/1955 | Mackney | 474/132 X |
| 2,810,164 | 10/1957 | Ambler et al. | 19/293 |
| 2,810,936 | 10/1957 | Altenburger | 19/293 X |
| 2,812,553 | 11/1957 | Coulliette | 19/293 X |
| 2,820,253 | 1/1958 | Winslow et al. | 19/293 X |
| 2,981,986 | 5/1961 | Neil | 19/293 X |
| 3,148,416 | 9/1964 | Hornbuckle | 19/293 X |
| 3,150,418 | 9/1964 | Rulon-Miller | 19/262 |
| 3,434,273 | 3/1969 | Lovell | 57/56 |
| 3,858,278 | 1/1975 | Schmitt et al. | 19/293 X |
| 3,869,759 | 3/1975 | Savageau et al. | 19/293 |
| 4,400,854 | 8/1983 | Socha | 19/159 R |
| 4,480,355 | 11/1984 | Vignon et al. | 19/293 X |
| 4,553,951 | 11/1985 | Pavone | 474/167 X |
| 4,781,015 | 11/1988 | Dinkelmann et al. | 474/148 X |
| 5,010,624 | 4/1991 | Stahlecker | 19/293 X |

FOREIGN PATENT DOCUMENTS

| | | | |
|---|---|---|---|
| 0699024 | 10/1940 | Fed. Rep. of Germany | 19/245 |
| 0553225 | 6/1932 | Fed. Rep. of Germany | 19/236 |
| 3141159 | 7/1982 | Fed. Rep. of Germany | 19/293 |
| 0185911 | 8/1936 | Switzerland | 19/131 |
| 0284770 | 12/1952 | Switzerland | 19/245 |
| 0524695 | 8/1972 | Switzerland . | |
| 0005985 | of 1887 | United Kingdom | 19/262 |
| 0262015 | 12/1926 | United Kingdom . | |
| 2078185 | 1/1992 | United Kingdom | 15/256.5 |

*Primary Examiner*—Clifford D. Crowder
*Assistant Examiner*—Ismael Izaguirre
*Attorney, Agent, or Firm*—Dority & Manning

[57] ABSTRACT

Drawing frame for drawing fiber sliver with draw frame rollers comprising a pair of pre-drawing rollers and a main drawing roller pair. Power transmission members in the form of flat belts are used for driving the draw frame rollers. A deflection pulley engages the flat belts between respective pairs of wheels deflecting the belts for increasing the angle that the flat belt extends around the respective wheels to provide a non-slip engagement between the flat belts and the respective wheels.

7 Claims, 3 Drawing Sheets

SLIVER DRAWING ROLLERS DRIVEN BY BELTS INCLUDING BELT CLEANERS

BACKGROUND OF THE INVENTION

1. Field of Invention

The instant invention relates to a drawing frame to draw fiber slivers with drawing rollers constituting pre-drawing and main drawing roller pairs and power transmission means to drive said drawing rollers as well as a sliver discharge mechanism.

2. Background of Art

The utilization of drawing rollers with two or more pairs of rollers to draw fiber slivers is known. The circumferential speed of the pairs of rollers increases from the inlet of the drawing frame to the outlet of the drawing frame. The lower roller of the roller pairs is driven by toothed wheels or toothed belts so to produce the slippage-free operation which is absolutely necessary for orderly drawing of the fiber slivers. The upper rollers are pressed against the lower rollers and the rollers thus clamp the fiber material running through between them.

It has been shown that toothed-wheel drives as well as toothed-belt drives of the drawing frame rollers have a detrimental effect upon the uniformity of fiber sliver drawing.

With toothed-wheel drives the clearance which exists between the individual teeth of the toothed wheels causes the roller pairs not to be driven simultaneously but one after the other, especially during run-up of the drawing-frame. This produces irregularities in the drawing of the fiber sliver.

DE-OS 20 44 996 proposes driving the drawing rollers via toothed belts. When such drives are used it was found that the accumulation of dirt between the teeth of the drive and deflection wheels over which the toothed belts are guided, as well as between the teeth of the toothed belt, cause irregular rotational movements of the drawing frame rollers to be produced. These irregularities lead to interference in the drawing of the fiber sliver as well as to increased wear of the drive elements. Especially where small toothed wheels are used and with toothed belts with small tooth divisions, such as are required for predrawing rollers because of the limited space available, soiling of the tooth clearances has a very detrimental effect. Manual cleaning of drive and deflection wheels as well as of the toothed belts is time consuming.

In addition to dirt, the oscillating characteristics of the drive means at the constantly increasing drawing speeds seriously impair the uniformity of fiber sliver drawing. Toothed-belt drives have unfavorable oscillating characteristics at high predrawing speeds.

SUMMARY OF THE INVENTION

It is the object of the instant invention to create a substantially maintenance-free drawing-frame roller drive without slippage between the drive element and the drawing-frame roller, making it possible to drive the drawing-frame rollers in an orderly, uniform and rapid manner.

This object is attained through the instant invention in that power transmission means are used to drive the drawing-frame rollers, whereby at least one of these power-transmission means is a flat belt wrapping around the driving wheels, with the loop of the flat belt wrapping around at least one of the driving wheels being increased by the installation of deflection pulleys. Flat belts surprisingly make it eminently possible to achieve high speeds of the drawing-frame rollers at delivery speeds of over 500m/min. Their utilization as power-transmission means to drive drawing-frame rollers has apparently failed until now because it did not appear possible to ensure slippage-free transmission of the drive forces in this manner. By installing deflection wheels to increase the angle of wrap of the flat belt around the driving wheels of the drawing-frame rollers it has been possible for the first time to achieve slippage-free and thereby precisely adjustable rotational speeds of drawing-frame rollers in the field of roller drawing frames. By providing deflection wheels, the wrap of the flat belt around the driving wheels is increased to such an extent that the power transmission makes it possible to achieve slippage-free and therefore precisely adjustable rotational speeds of drawing-frame rollers. By providing deflection wheels, the wrap of the flat belts around the driving wheels is increased to such an extent that the power transmission from drive motor to the drawing-frame rollers is slippage-free. A further advantage is achieved by applying deflection or driving wheels to the flat belts on both sides, one after the other. In this manner the flat belt is bent from the left side as well as from the right side per revolution. This varied bending of the flat belt ensures cleaning and thereby constant transmissible power.

The pre-drawing rollers are advantageously connected to each other by means of a flat belt for driving. This results in precise assignment of the speed conditions of the pre-drawing roller pair. If at least one deflection pulley is installed in the direction of belt movement between the driving wheels of the pre-drawing rollers, the flat belt extending around the deflection pulley and the driving wheels is bent alternately as it revolves and the wrap is thus increased.

An angle of wrap of at least 180° between flat belt and driving wheel of the lower drawing-frame roller has proven to be advantageous. With this wrap an essentially slippage-free drive of the pre-drawing rollers was obtained. If the flat belt is led over a deflection pulley installed on a tensioning lever provided with a spring element to produce the required belt tension, uniform running of the drawing-frame rollers is advantageously ensured.

Where flat belts are used in a very dusty environment, it is advantageous to install cleaning devices. These cleaning devices act upon the contact surfaces of the driving wheels, the deflection pulleys and of the running surfaces of the flat belts. This prevents impurities from being ground into the flat belt, the disks and the rollers, leading to unfavorable changes of the friction parameters that would cause slippage. This would lead to unwanted changes in the multiplication conditions of the drawing-frame rollers.

In order to change the draft of the fiber sliver it is advantageous for at least one of the driving wheels installed on the drawing-free rollers to be capable of being replaced. By using driving wheels with different diameters, changes in gear multiplication conditions are easily achieved.

In an advantageous further development of the device the flat belt is taken over a deflection pulley rotatably mounted on a free end of a tensioning lever capable of being swiveled around an axis. The tensioning lever is connected by means of a spring to a stationary housing part in such manner that the tensioning roller exerts a tensioning force upon the flat belt. The path of the spring is advantageously sufficiently great so that when different driving wheel diameters are used, the flat belt can still be brought to its desired tension. This desired tension can be set by means of a clamp screw provided on the tensioning lever.

Rubber has proven to be an advantageous material for the flat belts. Flat belts made of rubber achieve good results from the point of view of stretchability, slippage in combination with steel driving wheels and oscillation behavior. If the flat belts are provided with traction elements made of polyamide, good results are achieved in the draft uniformity of the fiber sliver.

If the flat belts are provided with aramide traction elements, the results can be further improved with respect to the oscillating behavior of the flat belt.

When flat belts are used where at least the surfaces coming into contact with the driving wheels are structured, high frictional values are obtained, contributing to slippage-free drive of the drawing-frame rollers.

BRIEF DESCRIPTION OF THE DRAWINGS

An embodiment of the invention is explained through the figures in which.

DESCRIPTION OF THE PREFERRED EMBODIMENT

Figure 1:
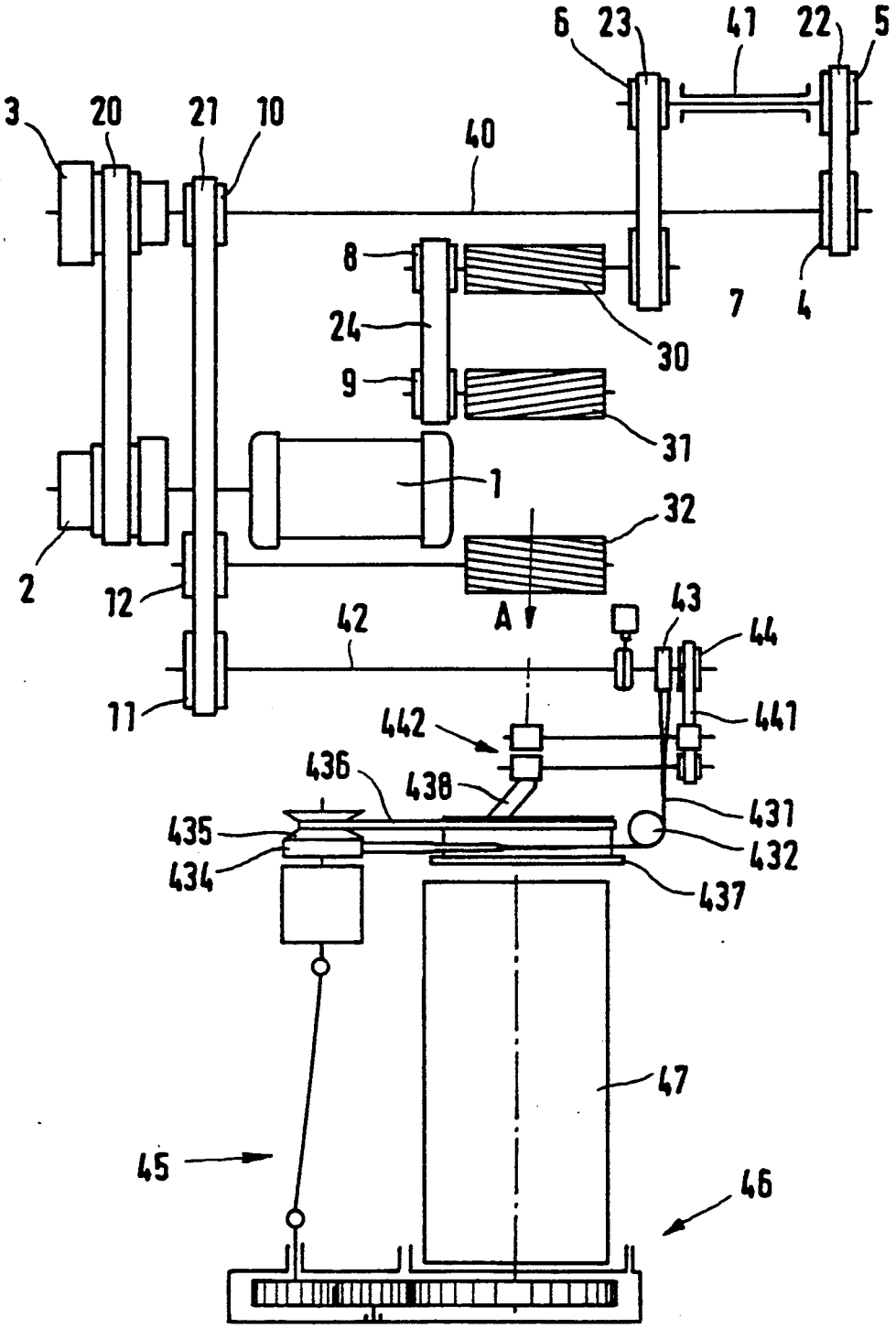
FIG. 1 shows a section of the gear plan of a drawing frame

The section of a gear plan of a drawing frame shown in FIG. 1 shows the connections between motor 1 and drawing-frame rollers 30, 31, 32. The lower drawing-frame rollers in particular are driven by means of flat belts. The rotation of the upper drawing-frame rollers is obtained by pressing the upper rollers against the lower rollers.

The driving wheels 2 driven by motor 1 are connected by means of a flat belt 20 and driving wheels 3 to a main drive shaft 40. The driving wheels 2 and 3 are made in the form of step rollers so that different gear multiplications can be achieved by wrapping the flat belt 20 therearound.

The rotations of the drawing-frame rollers 30, 31, 32 are adjusted from the main drive shaft 40 via driving wheels 4 and 10. The driving wheel 4 is connected for driving by means of a belt 22 and a driving wheel 5 to an intermediate drive shaft 41. The drawing-frame roller 30 is driven by the intermediate drive shaft 41 via driving wheels 6 and 7 which are connected to each other by a belt 23. Thanks to the arrangement of the driving wheels 4, 5, 6 and 7 which have different diameters, a suitable rotational movement can be transmitted to the drawing-frame roller 30 at a function of the fiber sliver to be drawn as well as of the draft to be imparted to the fiber sliver. By exchanging the wheels 4, 5, 6 or 7, changes in the rotational speed of the drawing-frame roller 30 can be achieved. Toothed belts 22 and 23 are preferably used for this drive in the draft modification gear system that includes the wheels 4, 5, 6 and 7. The degree of draft can be varied by changing the arrangement of the different diameter wheels 4, 5, 6 and 7.

The drawing-frame rollers 30, 31 effecting a pre-drawing of the fiber sliver are connected for drive by means of a flat belt 24. Through an appropriate selection of the diameter of the driving wheels 8 and 9 it is possible to achieve a rotational speed ratio between the drawing-frame rollers 30 and 31 that determines the extent of pre-drawing of the fiber sliver. Driving wheels 8 and 9 with a diameter essentially between 20 and 40 mm have been shown to be advantageous. For an adaptation to different fiber material to be drawn, the distance between drawing-frame rollers, in particular between the pre-drawing roller 30 and 31, can be changed.

A rotational movement serving to drive the calendar rollers 422 via a driving wheel 11 on an intermediary drive shaft 42 to drive the rotational tray 437 and the can tray 46 is selected from the main drive shaft 40 by means of the driving wheel 10 and a flat belt 21. The flat belt 21 furthermore selects the rotational movement of the drawing-frame roller 32 by means of a driving wheel 12. The drawing-frame roller 32 effects the main draft of the fiber sliver.

The fiber sliver delivered by the drawing-frame roller 32 and going into a running direction A is brought by the calendar rollers 442 into the discharge pipe 438 of the discharge wheel 437 and is discharged from this rotating discharge pipe 438 into a rotatable can 47. The calendar rollers 442 are driven via intermediary drive shaft 42 and a driving wheel 44 is driven via a flat belt 441. The rotating tray 437 is driven via a driving wheel 43 mounted on the intermediary drive shaft 42 by means of a flat belt 431 which drives the driving wheel 434 via deflection pulleys 432 in form of an V-drive, said driving wheel 434, being fixedly connected to driving wheel 43, driving the rotating tray 437 via flat belt 436. The utilization of a flat belt installed in form of a V-drive is much less expensive and more reliable in operation then a bevel-gear drive which can also be used. The can tray 46 is driven by means of drive 45 via driving wheel 434 to impart a rotational movement to the can 47 selectively during the filling process. This advantageous arrangement makes it possible to carry out an absolutely jolt-free depositing of the fiber sliver into the can and thereby also to ensure problem-free presentation at further processing machines.

Figure 2:
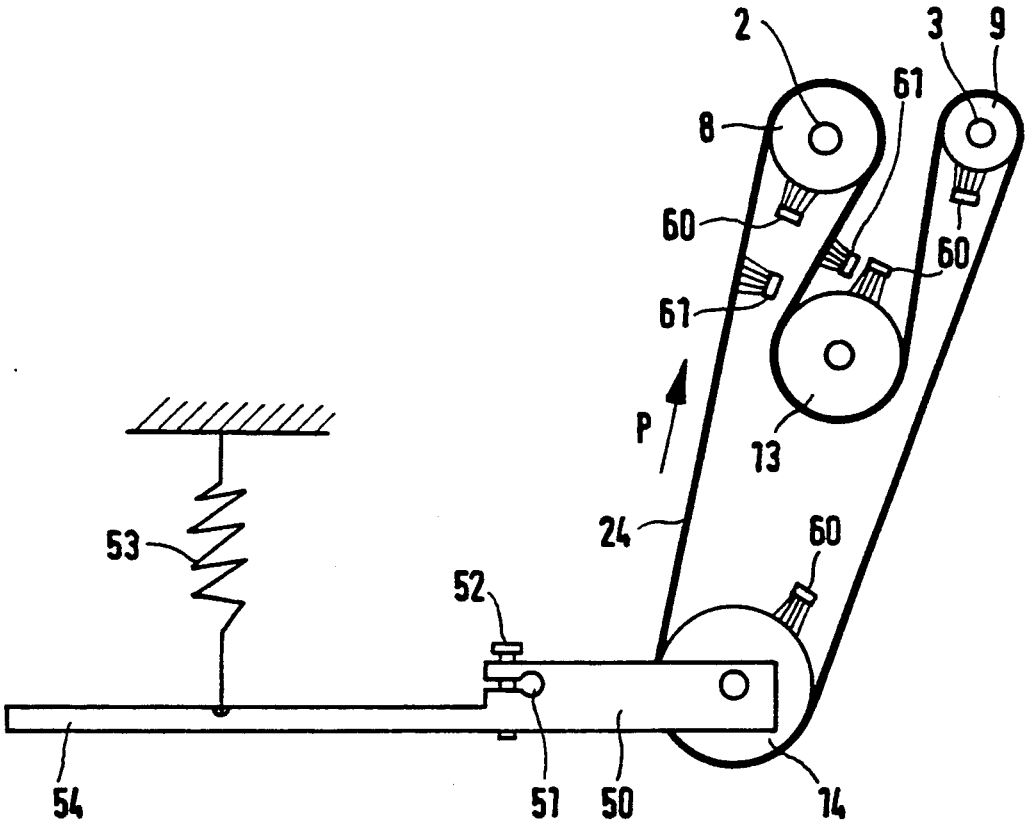
FIG. 2 shows a pre-drawing drive.

FIG. 2 shows the drive of the pre-drawing rollers. The driving wheels 8 and 9 are connected to each other for drive by means of the flat belt 24. A deflection pulley 13 is installed between the driving wheel 8 and the driving wheel 9. The deflection pulley 13 advantageously causes the driving wheels 8 and 9 to be contacted by the flat belt 24 over a large area of their circumferential surface. The driving disk 8 is surrounded by the flat belt 24 with an angle of wrap of over 180°. This also applies to the driving wheel 9. This driving wheel 9 is also surrounded by the flat belt 24 with an angle of wrap that is also greater than 180°. As a result the frictional force between the flat belt 24 and the driving wheels 8 or 9 is sufficiently great so that slippage-free driving of the drawing-frame rollers 30 and 31 connected to the driving disks 8 and 9 can be achieved. Rubber has proven to be an advantageous frictional partner for the flat belt 24 and steel for the driving wheels 8 or 9. Especially synthetic rubber, e.g. acrylonitrile butadien rubber with a structured surface yields good frictional values of 0.7. If the flat belts are provided with polyamide traction elements, the flat belts can be stretched to such an extent that the belt tension capable of being produced yields very quiet running and thus good drawing results.

The deflection pulley 13 is advantageously stationary and placed in such a manner between the driving wheels 8 and 9 that an angle of wrap of over 180° is ensured independently of the size of the driving wheels 8 and 9. In order to process different fiber materials, the distances between drawing-frame rollers are modified. In order to avoid a decrease of the angle of wrap to less than 180° for instance, at least two attachment points are provided for the deflection pulley 13 at which said deflection pulley 13 is held between the driving wheels 8 and 9 in a stationary manner.

To equal advantage, the deflection pulley 13 is installed in such manner that the tensioning roller and the deflection pulley are on the same side of the plane in which the axes of the predrawing drawing rollers lie. This plane divides the space into two areas, with the tensioning roller and the deflection pulley being both in one of these areas.

If flat polyamide belts are used the advantage is gained that this type of belt cannot be over-stretched in practice. Easy assembly of the flat belts is thereby possible. In case of highly precise drawing of the fiber sliver, or when extremely high drawing speeds are used, the utilization of flat belts provided with aramide traction bodies has proven advantageous. Such flat belts have an even better oscillating and stretching behavior than the polyamide belt, so that oscillations and rotational speeds of the drawing-frame rollers can be further reduced.

The tensioning of the flat belt 24 is effected by means of a deflection pulley 14 mounted on a tensioning lever 50. The tensioning lever 50 is mounted rotatably over a rotational axis 51. A spring 53 produces pre-tensioning of the flat belt 24 to a predetermined bearing tension. The deflection pulley 14 is fixed in its position by means of an adjusting screw 52. The path of the spring 53 is sufficiently long so as to compensate for the utilization of driving wheels 8 and 9 with different diameters producing a change in position of the deflection pulley 14 while the length of the flat belt 24 is maintained. A handle 54 is provided on the tensioning lever 50 in order to release the tension of the flat belt 24. The pre-tension of the belt 24 is reduced by loosening the adjusting screw 52 and by turning the handle 54 against the spring force in order to replace the flat belt 24 or to change the size or position of the driving wheels 8, 9. By fixing the tensioning lever 50 in this position by means of the adjusting screw 52, rapid and easy replacement of the flat belt 24 is made possible.

If different flat belts 24 are used, springs with different spring forces are used in function of the desired belt tension, these spring forces being adapted to these belt tensions. It may also be advantageous to provide several points of attachment of the spring 52 on the tensioning lever 50 so that the spring force may be varied by using different lever arms.

Wheel cleaners 60 are provided on the driving wheels 8 and 9 as well as on the deflection pulley 13 and on the tensioning roller 14. These disk cleaners 60 cause stripping of the contact surfaces between the disks and the flat belt 24. Accumulation of dirt on the disks, leading to faulty drawing of the fiber sliver is thus avoided. Such drawing faults are due on the one hand to the fact that dirt causes accelerations and decelerations of the driving wheels and on the other hand to the fact that changes in the friction coefficient provoke slippage between flat belt 24 and driving wheels 8 and 9. In a particularly dusty environment it is advantageous to bring such cleaning elements also into engagement with the contact surfaces on the flat belt 24. Band strippers 61 should be placed so that they strip off the flat belt 24 before contact with the driving disks 8 and 9. Cleaning devices of this type can of course also be used with the other flat-belt drives of the drawing frame.

Stripping brushes which are in contact with the disks, rolls and flat belt are most suitable cleaning devices.

Figure 3:
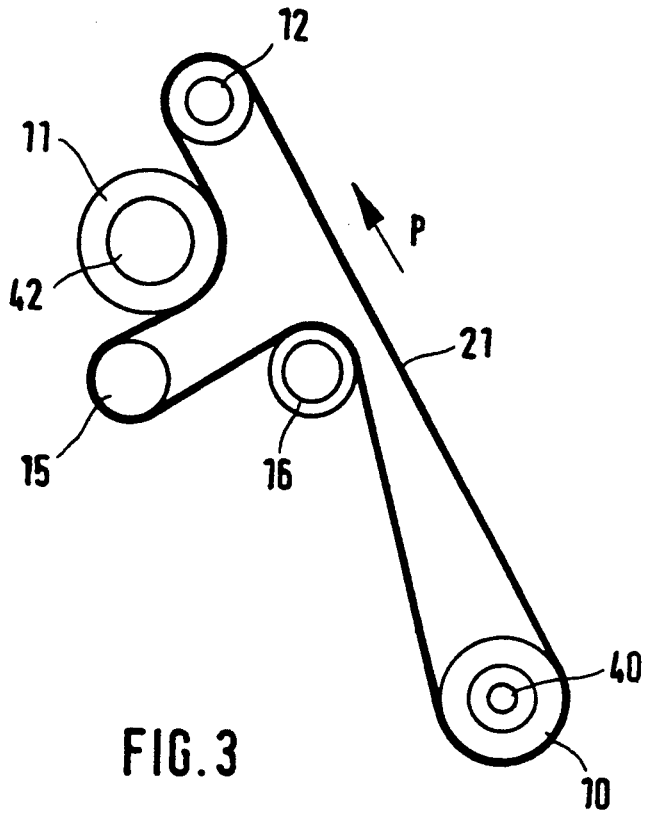
FIG. 3 shows a main drawing drive.

FIG. 3 shows the drive of drawing-frame roller 32 which serves to effect the main drawing action. The rotational movement is transmitted from the drive shaft 40 via a driving wheel 10 to the flat belt 21. In the embodiment of FIG. 3 the driving wheel 12 of the drive of the drawing-frame roller 32 on the one hand, and the driving wheel 11 of the drive of the intermediate driving shaft 42 on the other hand is moved by means of the flat belt 21. Two deflection pulleys 15 and 16 are provided after the driving wheel 11, in direction P of belt movement. These deflection pulleys 15, 16 cause the driving wheel 10 to be surrounded by flat belt 21 at a large angle of wrap. This ensures that the rotational movement of the main drive shaft 40 is transmitted without slippage to the flat belt 21. In the embodiment of FIG. 3 the driving wheel 11 of the intermediate drive shaft 42 serves as a deflection pulley to increase the angle of wrap of the flat belt 21 around the driving wheel 12, thus ensuring slippage-free driving of the drawing-frame roller 32.

By using high-faced driving wheels disks and deflection pulleys, good lateral guidance of the belts is ensured.

The instant invention is not limited to the embodiment shown here. Drawing frames according to the instant invention can be used wherever fiber slivers or roves are to be drawn at particularly high speeds. This not only applies to the drawing frames described here, but also to drawing frames of spinning machines, for example.

I claim:

1. Drawing frame for drawing fiber sliver with drawing frame rollers comprising a pair of pre-drawing rollers, and a pair of main drawing rollers, each of said rollers being fixed to a respective shaft, a wheel for driving each of said shafts being fixed adjacent an end of each respective shaft, power transmission means engaging said wheels for driving said draw frame roller's wherein at least one of said power transmission means is a flat belt surrounding a respective pair of said wheels, a deflection pulley engaging and deflecting said flat belt between said respective pair of said wheels, said deflection increasing an angle that form as said flat belt wraps around said respective wheels for providing a non-slip engagement between said flat belt and said respective wheels and cleaning devices in contact with said flat belt.

2. The drawing frame as set forth in claim 1 further comprising:

cleaning devices in contact with at least some of said wheels.

3. The drawing frame as set forth in claim 2 wherein said cleaning devices are stripping brushes.

4. The drawing frame as set forth in claim 1 further comprising:

a can for receiving said drawn slivers, a rotational tray carried on top of said can for guiding said drawn sliver into said can, a second flat belt means for driving said rotational tray.

5. The draw frame as set forth in claim 1 wherein said cleaning devices includes a second deflection pulley carried adjacent said first mentioned deflection pulley on an opposite side of said flat belt for deflecting said belt in an opposite direction from which said first mentioned pulley is deflecting said belt.

6. Drawing frame for drawing fiber sliver with drawing frame rollers comprising a pair of pre-drawing rollers, and a pair of main drawing rollers, each of said rollers being fixed to a respective shaft, a wheel for driving each of said shafts being fixed adjacent an end of each respective shaft, power transmission means engaging said wheels for driving said draw frame roller's, wherein at least one of said power transmission means is a flat belt surrounding a respective pair of said wheels, a deflection pulley engaging and deflecting said flat belt between said respective pair of said wheels, said deflection increasing an angle that form as said flat belt wraps around said respective wheels for providing a non-slip engagement between said flat belt and said respective wheels and wherein said flat belt is reinforced with traction elements made of aramide.

7. Drawing frame for drawing fiber sliver with drawing frame comprising a pair of pre-drawing rollers, and a pair of main drawing rollers, each of said rollers being fixed to a respective shaft, a wheel for driving each of said shafts being fixed adjacent an end of each respective shaft, power transmission means engaging said wheels for driving said draw frame rollers, wherein at least one of said power transmission means is a flat belt surrounding a respective pair of said wheels, a deflection pulley engaging and deflecting said flat belt between said respective pair of said wheels, said deflection increasing an angle that forms as said flat belt wraps around said respective wheels for providing a non-slip engagement between said flat belt and said respective wheel, and said flat belt is reinforced with traction elements made of polyamide.

* * * * *